US006869273B2

(12) United States Patent
Crivelli

(10) Patent No.: US 6,869,273 B2
(45) Date of Patent: Mar. 22, 2005

(54) MICROELECTROMECHANICAL DEVICE FOR CONTROLLED MOVEMENT OF A FLUID

(75) Inventor: Paul Crivelli, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 29 days.

(21) Appl. No.: 10/147,153

(22) Filed: May 15, 2002

(65) Prior Publication Data

US 2003/0215335 A1 Nov. 20, 2003

(51) Int. Cl.[7] ..... F04B 19/24

(52) U.S. Cl. ..... 417/53; 417/207; 417/208; 137/828

(58) Field of Search ..... 417/53, 48, 207, 417/208, 505; 137/828, 825; 385/15–19

(56) References Cited

U.S. PATENT DOCUMENTS 5,479,196 A * 12/1995 Inada ..... 347/92
5,699,462 A 12/1997 Fouquet et al. ..... 385/18
5,732,168 A 3/1998 Donald ..... 385/16
5,751,317 A * 5/1998 Peeters et al. ..... 347/65
5,828,799 A 10/1998 Donald ..... 385/16
5,846,396 A * 12/1998 Zanzucchi et al. ..... 204/601
5,852,689 A 12/1998 Donald ..... 385/21
5,871,336 A * 2/1999 Young ..... 417/207
5,872,582 A 2/1999 Pan ..... 347/65
5,876,187 A 3/1999 Afromowitz et al. ..... 417/322
5,975,856 A * 11/1999 Welle ..... 417/53
5,978,527 A 11/1999 Donald ..... 385/17
6,055,344 A 4/2000 Fouquet et al. ..... 385/16
6,062,681 A * 5/2000 Field et al. ..... 347/65
6,188,815 B1 2/2001 Schiaffino et al. ..... 385/16
6,208,778 B1 3/2001 Donald ..... 385/17
6,212,308 B1 4/2001 Donald ..... 385/16
6,283,718 B1 * 9/2001 Prosperetti et al. ..... 417/52
6,360,775 B1 * 3/2002 Barth et al. ..... 137/828
6,531,417 B2 * 3/2003 Choi et al. ..... 438/800
6,655,924 B2 * 12/2003 Ma ..... 417/209

OTHER PUBLICATIONS

Elwenspoek, et al., "Mechanical Microsensors", Springer–Verlag, Berlin, 2001, pp. 10–13.

* cited by examiner

*Primary Examiner*—Charles G. Freay

(57) ABSTRACT

A microelectromechanical (MEM) device for controlled movement of a fluid. The device includes a chamber having a heating element, an inlet, and a constricted egress channel.

46 Claims, 9 Drawing Sheets

MICROELECTROMECHANICAL DEVICE FOR CONTROLLED MOVEMENT OF A FLUID

FIELD OF THE INVENTION

This invention pertains to a pump for a microelectromechanical system, and, more specifically, to a pump exploiting the principles of fluid mechanics to draw fluid from a reservoir and project it along a channel.

BACKGROUND OF THE INVENTION

The earliest computers were huge labyrinths of wires and vacuum tubes, perhaps best characterized by the dream of a "computer that will fit in a room" immortalized in the movie Apollo 13. The development of the transistor enabled an immediate miniaturization of electronic components, and researchers have continued to develop smaller and smaller semiconductor devices. As ever-smaller devices were developed to perform more and more functions at faster rates, devices have shrunk from room-sized behemoths to portable personal computers to handheld personal digital assistants (PDA's) that are quickly replacing pocket calendars and personal organizers.

As electronic circuitry becomes smaller and smaller, the techniques for fabricating these electronic devices are also being exploited to produce lilliputian mechanical devices. Miniature accelerometers control the inflation of airbags in automobiles. Techniques for fabricating microelectromechanical systems ("MEMS") have also been used to produce microscopic gears and actuators. MEMS including arrays of tiny mirrors, each rotated individually in response to a miniature control circuit, are used to digitally project movies onto theater screens. However, most MEMS have tiny moving parts that are easily broken but not so easily repaired. Furthermore, moving parts in MEMS devices often stick to each other, preventing further motion and rendering the device useless. As a result, it is desirable to fabricate a MEMS device that is more robust.

SUMMARY OF THE INVENTION

The invention is a microelectromechanical (MEM) device for controlled movement of a fluid. The device includes a chamber having a heating element, an inlet, and a constricted egress channel.

BRIEF DESCRIPTION OF THE DRAWING

The invention is described with reference to the several figures of the drawing, in which.

DETAILED DESCRIPTION

The invention includes a microelectromechanical (MEM) device for pumping a fluid. The device comprises a chamber having a heating element and a channel providing egress from the chamber. The channel includes a constriction. The device may have a series of chambers and channels in fluidic communication. In addition, the invention includes a method for coordinating activation of the heating elements in subsets of the chambers. For example, the chambers may be divided into groups of three, four, or more chambers within which the heating elements are activated sequentially.

The device may include a fluid reservoir and an inlet that provides fluidic communication between the reservoir and one or more of the constrictions. When the heating element in one of the chambers is activated, it vaporizes a portion of the fluid in the chamber, causing fluid to flow through the egress channel and into a downstream chamber. Activation of the downstream heating element continues projection of the fluid through the channels. A chamber may include two or more egress channels leading to downstream chambers instead of or in addition to a heating element. Heating elements in the downstream chambers may be electrically controlled to permit fluid to flow through specific downstream paths. In addition, the invention includes a method for pumping a fluid utilizing a series of chambers and channels.

Figure 1A:
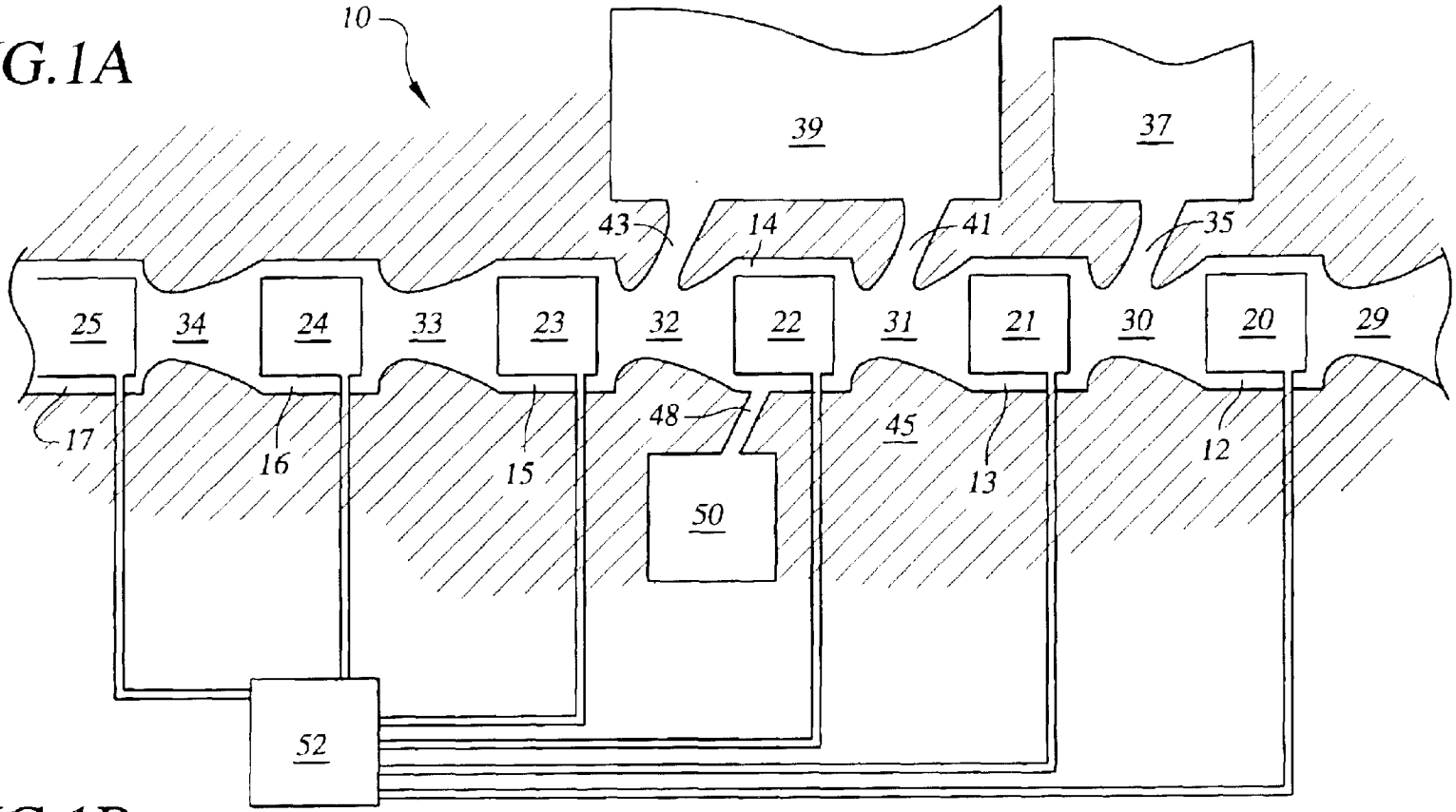
FIG. 1A is a diagram of a microfluidic pump according to one embodiment of the invention.
Figure 1B:
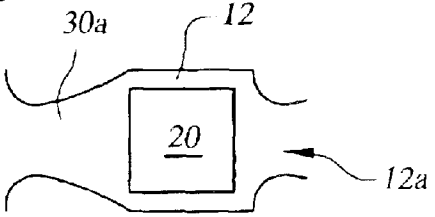
FIG. 1B is a diagram of an individual chamber for use with an embodiment of the invention.

The invention exploits physical principles such as resistive heating and Bernoulli's principle to create a pump for a microelectromechanical system (MEMS). The pump 10 includes a series of chambers, for example, chambers 12–17 (FIG. 1A). Each chamber includes a heating element, for example, sheet resistors 20–25. The chambers are connected in series via channels, for example, channels 30–34. Channels 30–34 each have a constriction, for example, constriction 30*a* in FIG. 1B. FIG. 1B depicts an individual chamber 12 having an inlet 12*a* and egress channel 30*a*.

To operate the pump, a voltage is applied to sheet resistor 20. The voltage is applied in a step profile with a period on the order of microseconds and generates enough heat to vaporize a portion of a fluid disposed in chamber 12. The resulting explosive vaporization displaces the remaining fluid in chamber 12 into channel 30 and from thence into chamber 13. Fluid that is already in channel 30, chamber 13, channel 31, etc., will also be displaced towards the left in FIG. 1 in response to the displacement of fluid through channel 30. After the voltage is removed, the vaporized fluid immediately cools and condenses. However, because the chamber 12 is not full, more fluid can be drawn in through channel 29. At a predetermined time following application of the first voltage, a voltage is applied to sheet resistor 21. The resulting heat vaporizes fluid in chamber 13, causing it to displace condensed fluid through channel 31 into chamber 14. For example, if the voltage is applied for 5 $\mu$s, with a "rest period" of 10 $\mu$s for bubble collapse, then the second voltage should be applied between 5 and 15 $\mu$s after the first voltage. Longer intervals provide more time for the fluid to progress through the pump between voltage applications and more time for heat dissipation. Shorter intervals result in a more consistent pressure on the fluid in the pump. In the above example, a 5 $\mu$s interval would cause the second bubble to form just as the first bubble reached its maximum size, while a 15 μs interval would cause the second bubble to form after the bubble cycle in the first chamber had collapsed.

As the vaporized fluid cools, the resulting vacuum causes fluid in channel 30 to progress into chamber 13. Fluid in chamber 12 moves into channel 30, and chamber 12 is refilled from channel 29. Furthermore, fluid in channel 31 exerts pressure on fluid in chamber 14, channel 32, etc., causing it to proceed through the pump. The process is repeated for sheet resistors 22, 23, etc. Because the chambers are so small (approximately 10–50 μm or greater on a side), the chambers are not only refilled by vacuum, but by capillary action of the fluid along the walls of the chambers.

The pump 10 is fabricated on a substrate, for example, a silicon wafer. The circuitry to control the resistors 20, 21, 22, etc. is deposited on the substrate, as are the resistors themselves. Exemplary resistors include TaA1 thermal ink jet (TIJ) resistors. A photoimagable polymer (photoresist), for example, SU-8 (MicroChem, Newton, Mass.), PARAD™ (DuPont), or VACREL™ (DuPont), is deposited over the circuitry and exposed to light through a mask having a pattern corresponding to the desired pattern of chambers 12, 12, 14, etc., channels 29, 30, 31, etc., and other features of the pump 10. The unexposed portions of the polymer are washed away. Alternately, a polyimide or other film may be deposited on the substrate and laser ablated to form the desired pattern. The tops of the chambers are sealed with a hole-free material such as a polyimide (e.g., KAPTON™ from DuPont, UPILEX™ from UBE Industries/INI America, and APICAL™ from Kaneka High-Tech Materials). The polyimide forms a seal with the polymer upon application of heat. A passivation layer, for example, tantalum, may be applied over the circuitry to prevent generation of a short circuit during operation of the pump.

The size of the chambers 12–17 and the timing of the applied voltage determine the capacity of the pump. The chamber depth is defined by the thickness of the photoimagable polymer, typically 14 or 19 μm. While deeper channels are possible, it is preferable to keep the aspect ratio of the chambers short and wide. Accordingly, the chamber depth is preferably between 10 and 30 μm. While smaller chambers are possible, they may be difficult to manufacture or propel fluid through. The channels should be 2–3 times the side length of the resistor to provide an adequate gap between them. For example, for a 20 μm resistor, the channel should be long enough so that there is about 40–60 μm between the resistors.

The throughput may be increased and the pressure within the pump equalized by applying a voltage to more than one resistor at a time. In one embodiment, the chambers may be divided into groups. A voltage may be applied to the first resistors in each group simultaneously, then to the second resistors, etc. For example, if the resistors in FIG. 1 are divided into groups of three, then voltages are applied to sheet resistors 20 and 23 simultaneously. At a specified interval after application of the voltage, a second voltage is applied to sheet resistors 21 and 24. Sheet resistor 22 will experience a voltage simultaneously with sheet resistor 25. The cycle is then repeated with application of voltage to sheet resistors 20 and 23. Alternatively, the chambers may be grouped in longer chains of four or more. If groups of four are used, voltage is applied to sheet resistors 20 and 24 simultaneously, followed by sheet resistors 21 and 25, and so on. Controller 52 may be programmed to apply a voltage to the resistors in a variety of patterns. In a long series of chambers, the vaporized bubbles of fluid will appear to travel in the same way that light appears to travel around a movie marquee. Just as the lights merely flicker on and off in a time sequence to create the illusion of movement, the vaporized bubbles do not actually travel through the pump but are sequentially created and allowed to condense in the various chambers. As for the movie marquee, a skilled artisan can easily design and program a control circuit to control the sequence, timing, and frequency of the voltage applied to the various sheet resistors in the pump.

The voltage should be applied long enough to create sufficient pressure to propel the fluid. For example, a minimum application time of 1 μs is preferred when thermal ink jet-type (TIJ) resistors are used. To increase the efficiency of the system, the time between voltage applications may be optimized to allow the fluid to travel as far as it can under the pressure created by the previous voltage application. The speed with which the fluid is directed through the chambers and channels depends partially on the viscosity of the fluid but can be controlled by adjusting the intervals at which voltage is applied to sheet resistors 20, 21, 22, and 23. For example, if chambers 12, 13, 14, etc., are 30 μm on a side and 19 μm deep, then a flow rate of about $2.7\times10^{-4}$ cc/s, or 0.016 cc/min, may be achieved for a voltage frequency of 15 kHz.

The required voltage depends in part on the resistance of the sheet resistor. The required energy to vaporize a fluid and create a bubble ("flash vaporization"), called the turn-on energy (TOE), is a constant for a given fluid. The TOE is the product of the power delivered and the time the resistor is on, or $$TOE=(V^2/R)\ (\text{Pulse Time})$$

The resistance R of a square sheet resistor having resistivity ρ depends only on its thickness. Most fluids have turn-on energies between 2 and 6 μJ. In one example, application of a 7 mV pulse to a 36 mΩ resistor for 2 μs delivers 2.7 μJ of energy to the fluid. Almost any aqueous solution may be pumped using the techniques of the invention. As the fraction of water decreases, the TOE increases. For example, a fluid that is about 75% water, such as an ink-jet ink, has a TOE of about 3 μJ. One skilled in the art will recognize that the TOE for a given fluid may be determined without undue experimentation.

The channels 29, 30, 31, and 32 remain constricted as they enter their respective downstream chambers. This minimizes projection of the fluid upstream when the bubble is created. This constriction also requires the fluid to increase in velocity as it travels from one chamber to the next. As the fluid increases in velocity, Bernoulli's principle dictates that the fluid generates a region of lower pressure. As fluid travels through channel 30, the resulting low pressure draws liquid from reservoir 37 via inlet 35. As a result, a second fluid can be mixed with the fluid that is already being directed through the pump. Additional reservoirs may be disposed along the pump to add various fluids to the mixture. To prevent generation of a vacuum in the reservoir as fluid is removed, they may be open to the atmosphere. Alternatively, a flexible chamber, or one sufficiently large to avoid creation of a vacuum, may be employed, or the reservoir may be periodically refilled.

Figure 2:
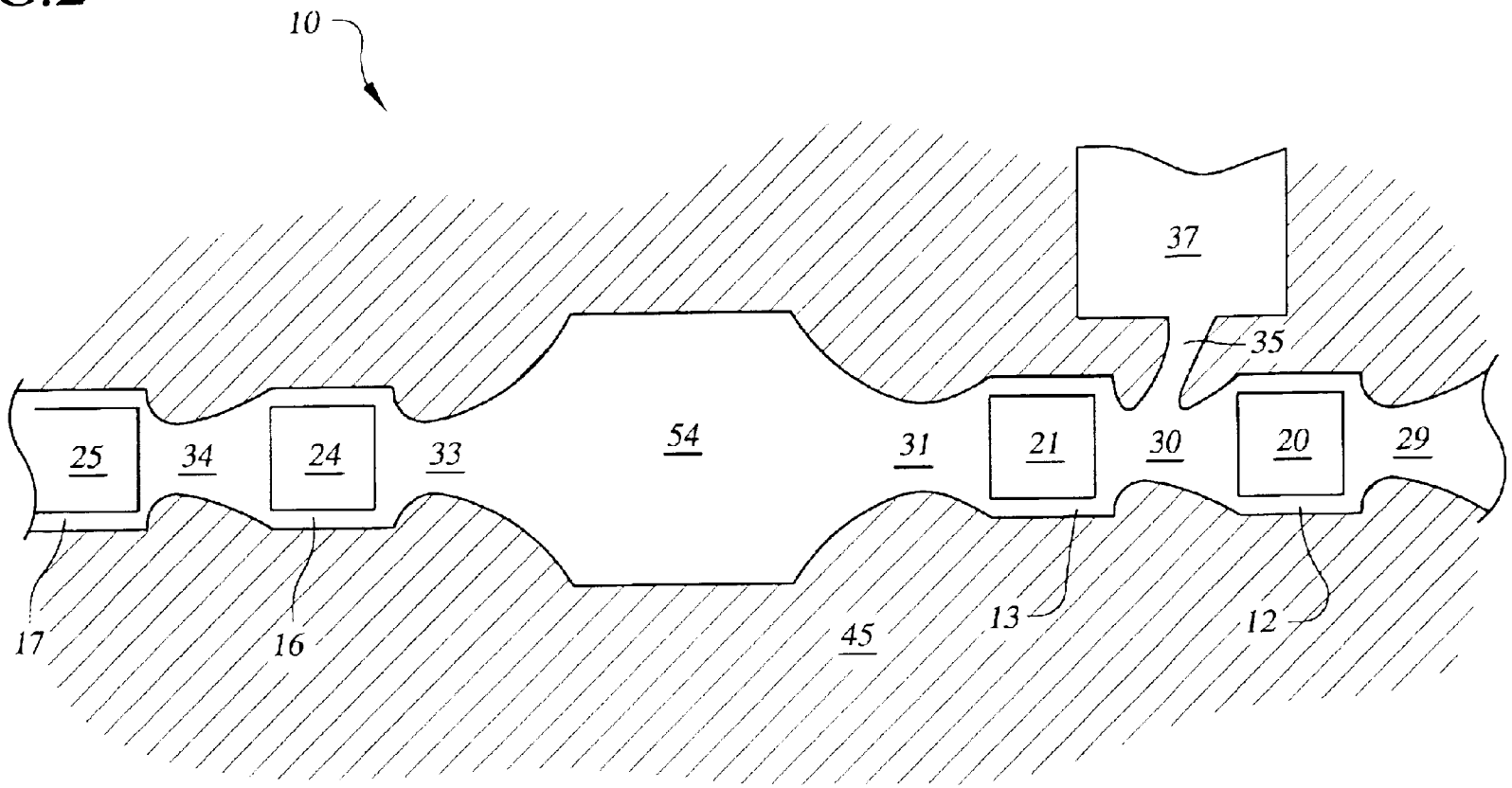
FIG. 2 is a diagram of a microfluidic pump according to an alternative embodiment of the invention.

In FIG. 1A, a larger reservoir 39 has two inlets 41 and 43 via which a fluid may be added to the fluid in channels 31 and 32. The amount of fluid that is drawn from reservoir 37 is partially determined by the speed of the fluid that is already in channel 30. This in turn depends on the viscosity of the fluid, the size of the resistors, the frequency of the pump, and the pressure from fluid downstream. In addition, the flow rate that the pumped fluid can entrain through inlet 35 also depends on the viscosity of the fluid in reservoir 37. For fluids of a given viscosity, the rate of fluid flow within the pump and the amount of fluid drawn from reservoirs 37 and 39 can be easily controlled by modifying the chamber and channel size, the inlet width, and the frequency of the voltage pulses. Because of the pulsatile pumping action, fluid flow through pump 10 is not laminar. The resulting turbulence facilitates mixture of the entrained fluids and the pumped fluid within the chambers. For example, the fluid entering the stream through inlet 35 mixes with the fluid in chamber 13. Alternatively, the pulsed motion of the fluid may be damped by including an accumulator chamber in the pump. FIG. 2 shows pump 10 from FIG. 1 with chambers 22 and 23 replaced by accumulator chamber 54. Such a chamber may be useful for in situ analysis of the fluid and is preferably larger than the chambers that have resistors, for example, 1.5 times as large or greater.

Figure 3:
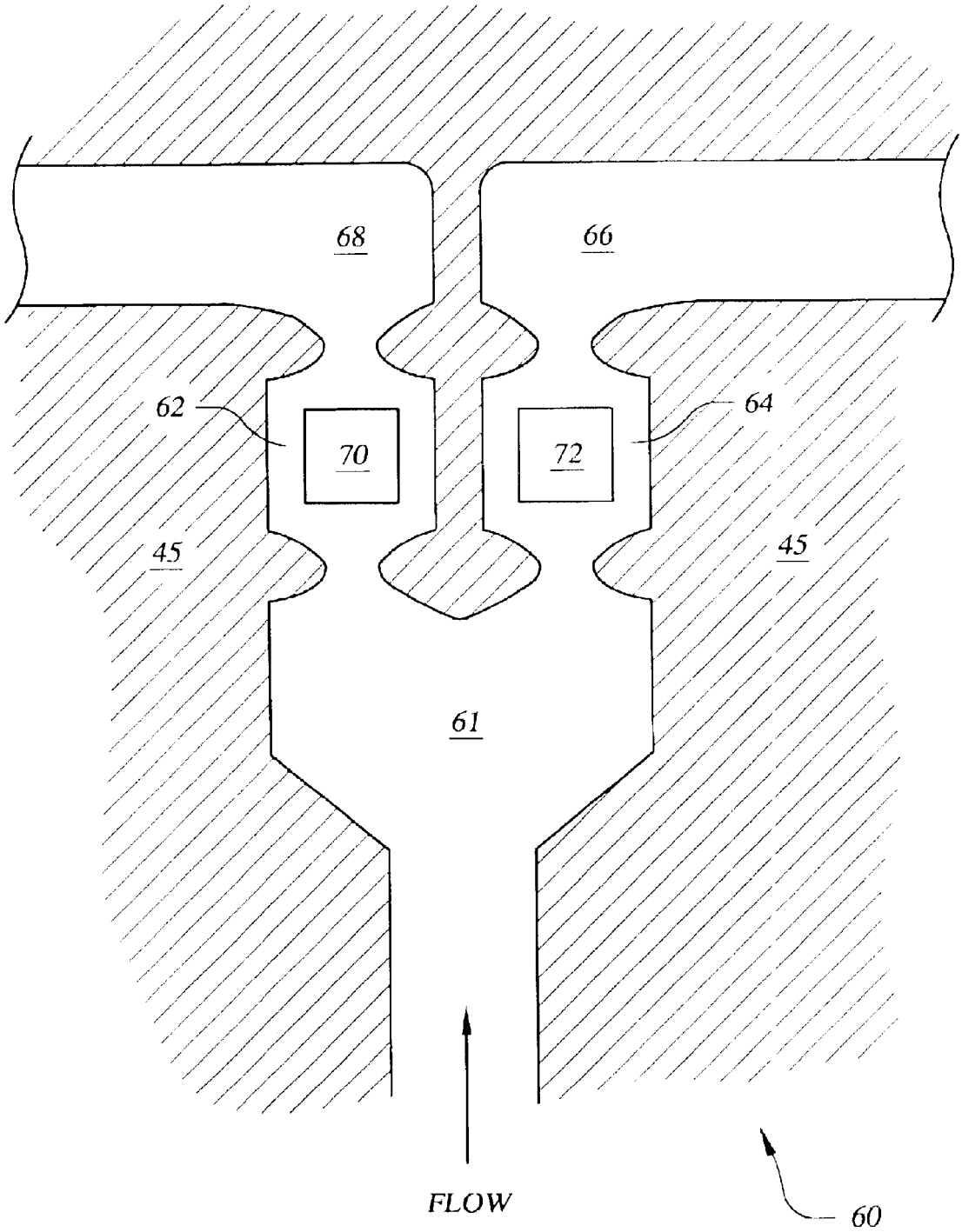
FIG. 3 is a diagram of a gate valve for a microfluidic pump according to one embodiment of the invention.
Figure 4:
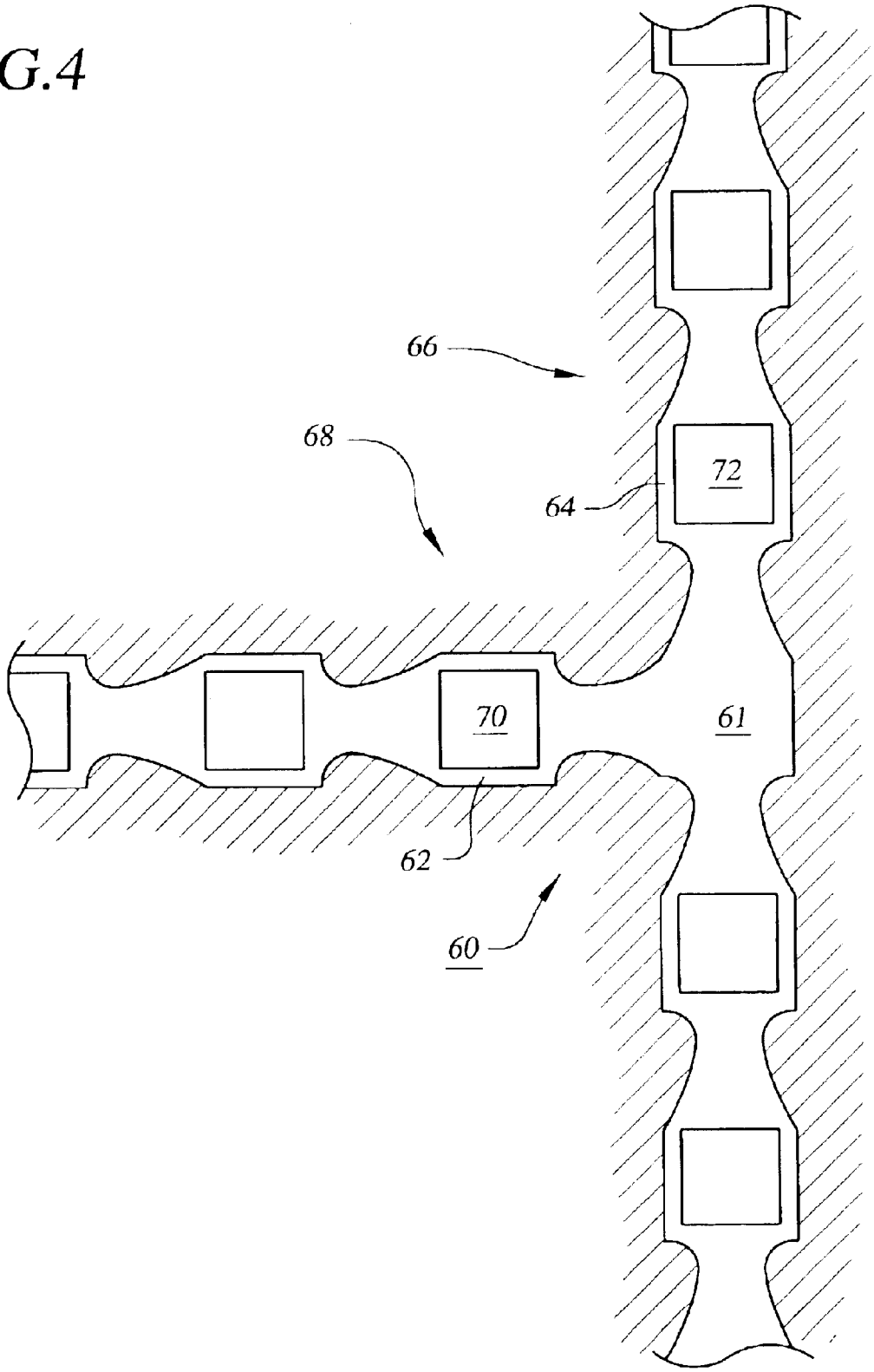
FIG. 4 is a diagram of a gate valve for a microfluidic pump according to one embodiment of the invention.
Figure 5A:
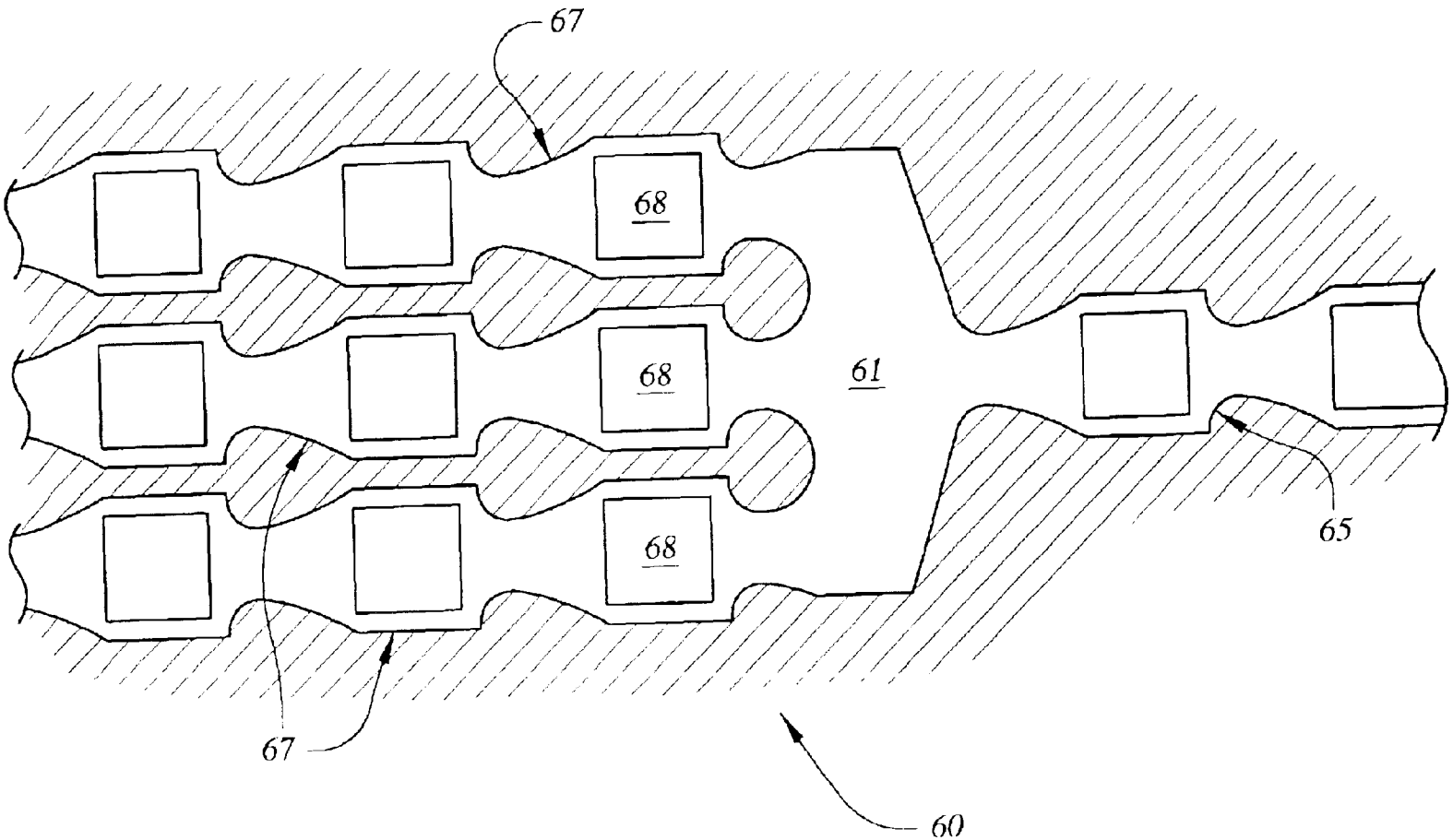
FIGS. 5A and 5B are diagrams of gate valves for a microfluidic pump according to certain embodiments of the invention.
Figure 5B:
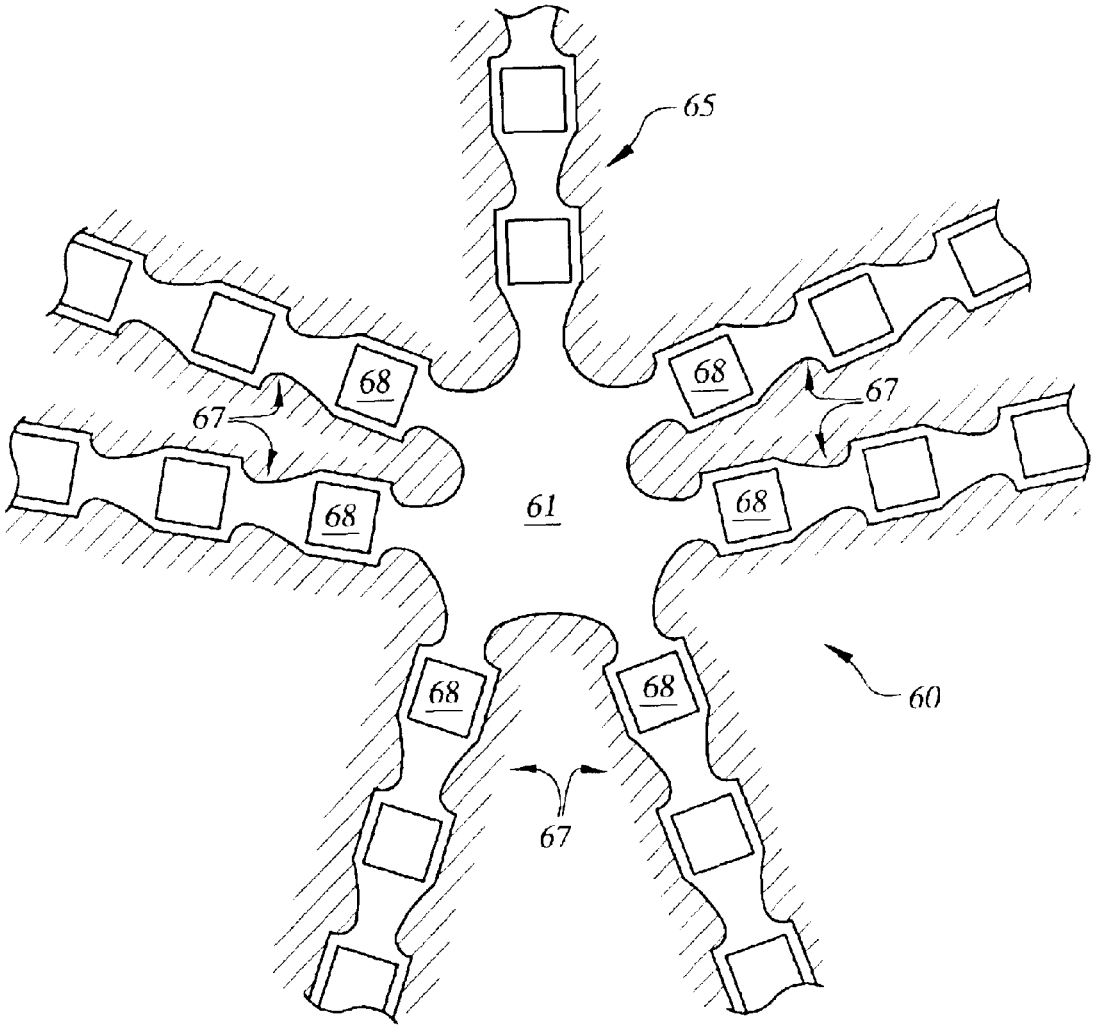

The technology of the invention may also be used to fabricate a gate valve (FIG. 3). The gate valve 60 includes an entrance chamber 61 and two gate chambers 62 and 64 that control access to downstream paths 66 and 68. Chambers 62 and 64 contain sheet resistors 70 and 72, respectively. As fluid approaches gate valve 60, it may proceed through either downstream path 66 or downstream path 68 unless one of chambers 62 or 64 is blocked. For example, if voltage is applied to sheet resistor 70, a bubble will form within chamber 62. The bubble will be trapped within chamber 62 by the constrictions on either side of the chamber, thereby blocking access to downstream path 68. Turning off the voltage will permit the bubble to collapse and allow access to downstream path 68. Likewise, application of a voltage to sheet resistor 72 will cause a bubble to form within chamber 64, blocking access to downstream path 66. The gate valve may be used to change the flow path, separate the fluid into two streams or to periodically remove fluid from the pump for analysis or some other application via one of the downstream paths. In one embodiment, entrance chamber 61 for the gate valve 60 has a larger volume than either of chambers 62 or 64. However, this is not necessary. For example, entrance chamber 61 may be the nexus of a T-junction (FIG. 4) or other junction between the inlet path and the outlet paths. In another embodiment, the gate valve 60 may control the passage of the fluid from an inlet path 65 into any of several paths 67 via gate chambers 68, as shown in FIGS. 5A and B. The fluid may continue to be pumped once it has entered one of the downstream paths. Of course, the sheet resistors in gate chambers 68 may be controlled to allow fluid into several downstream paths 67 simultaneously. If several downstream paths 67 have a common outlet, the parallel paths may be used to increase the throughput of the pump.

Because the fluid is heated for such a short time, many fluids and materials that are ordinarily heat sensitive may be directed through the pump of the invention without damage. For example, even if a protein is sensitive to heat, if it does not denature in the few microseconds of elevated temperatures, its conformation may not be affected by the pumping mechanism.

In addition, the sides of the chambers and channels may also be coated with materials to enhance or prevent interactions of the surface with the pumped fluids. For example, a passivation layer of Ta on the sheet resistor will prevent cognation of ink. Catalysts such as Pt and Pd may be immobilized in the chambers or channels, or the surfaces of the pump may be treated to generate an oxidized layer at the surface of the silicon. Biological molecules or chemical coatings may attract or repel proteins or sugars. Exemplary molecules include extracellular matrix proteins, albumin, amino acid sequences, cell adhesion sequences such as -R-G-D-, synthetic peptides, various proteins and enzymes, and sugars such as lectin binding sugars. Molecules may also be chosen that have specific receptors, such as antibodies and antigens, cell surface receptors and ligands, etc. These molecules may modify a surface, enabling the immobilization of biological molecules, molecular fragments, cells, or cell components. In addition, a variety of biological materials can be used to prevent the attachment of others. For example, intact and fractionated cells and organelles, lipids, simple and complex carbohydrates, and some proteins and nucleic acids have a low affinity for biological molecules and cells.

The fluid in the pump may also be analyzed. In one embodiment, an outlet 48 is disposed in the downstream side of a chamber (FIG. 1). When fluid is propelled from the chamber, a small amount will enter the outlet and flow to a collector 50 or other structure disposed downstream. Alternatively, a sensor may be disposed in a chamber or channel. An electrical circuit may be provided to measure pH, resistance, temperature, or some other characteristic of the fluid. Spectrographic analysis may also be provided if a wall or cover of at least a portion of the pump is sufficiently transparent or if a chamber or channel is fabricated with a fiber optic filament.

Figure 6:
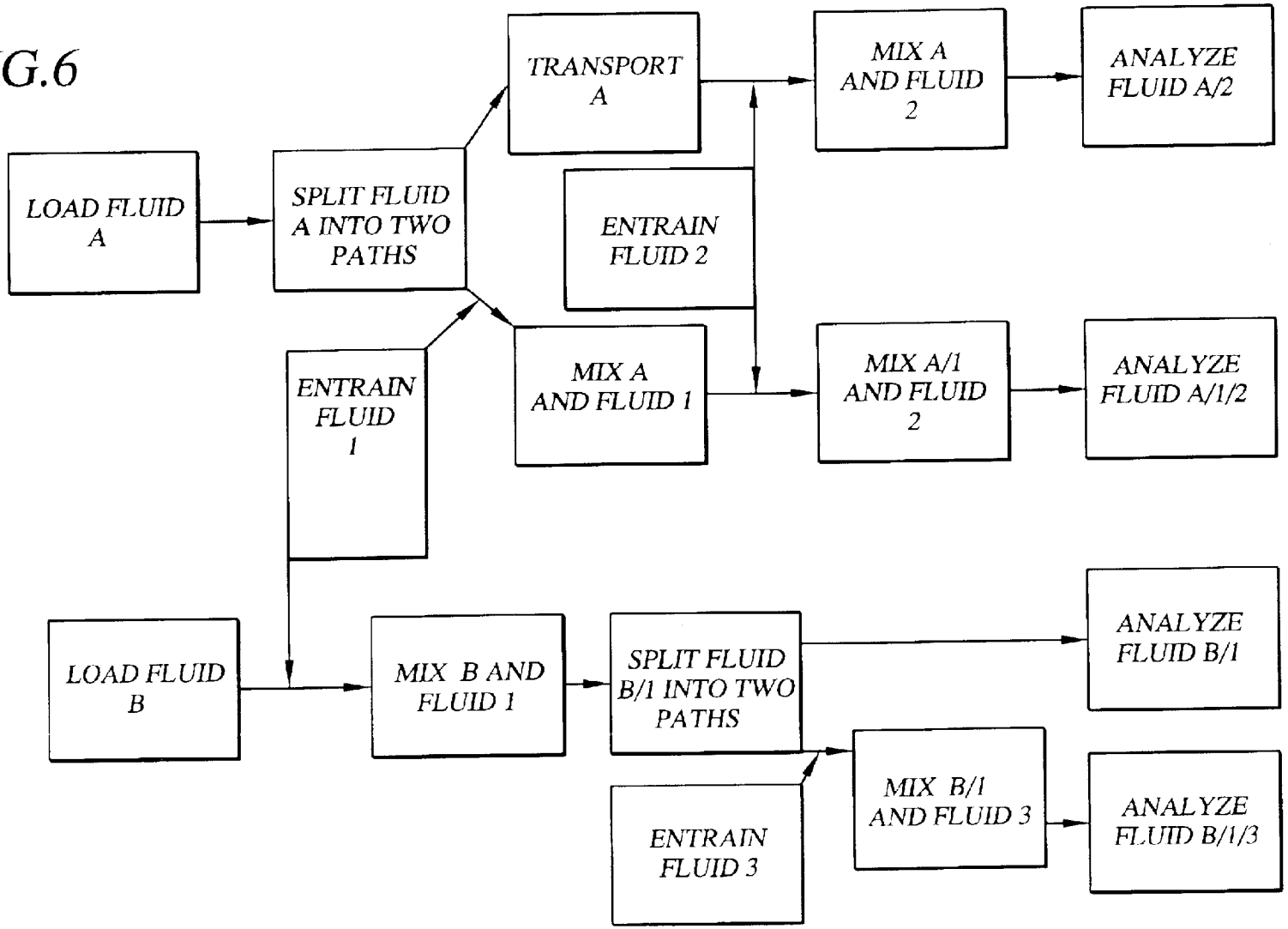
FIG. 6 is a flow chart of an exemplary lab on a chip employing the techniques of the invention.

These pumps may be used for so-called "lab on a chip" applications, enabling smaller quantities of large numbers of fluids to be mixed and analyzed simultaneously. This would reduce the quantity of material required for such chips and increase the number of reagents that can be used on a single chip. FIG. 6 is a block diagram of an exemplary segment of a lab on a chip. Two fluids A and B are loaded onto a chip. They are pumped past reservoirs where they entrain various combinations of fluids 1, 2, and 3 and are split into different paths to increase the number of possible combinations of fluids. Four products, A/2, A/1/2, B/1, and B/1/3, are produced on the chip and are analyzed. The fluids may mix with one another to form a solution or emulsion or contain components that react to form a new chemical species, a chelate, or some other product.

The invention increases the channel lengths and velocities that can be employed for "lab on a chip" and other applications. Without a pumping action, the fluids can only proceed as far and as fast as they can propel themselves through capillary action or under the direction of an applied voltage through capillary electrophoresis. Pumping enables a greater range of reaction times and higher throughputs.

Figure 7A:
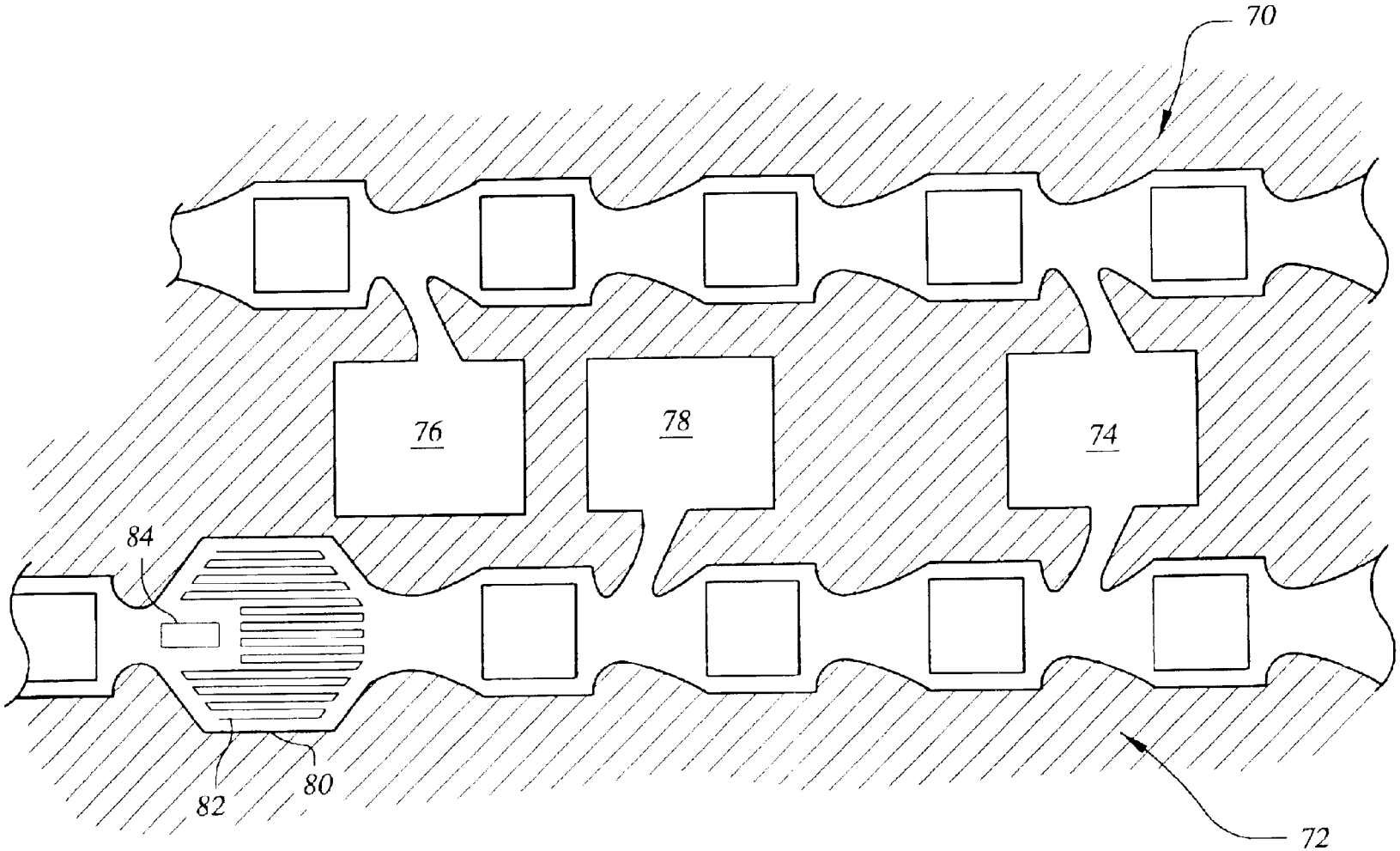
FIG. 7A is a diagram of a portion of an exemplary microfluidic reactor employing a pump according to an embodiment of the invention.
Figure 7B:
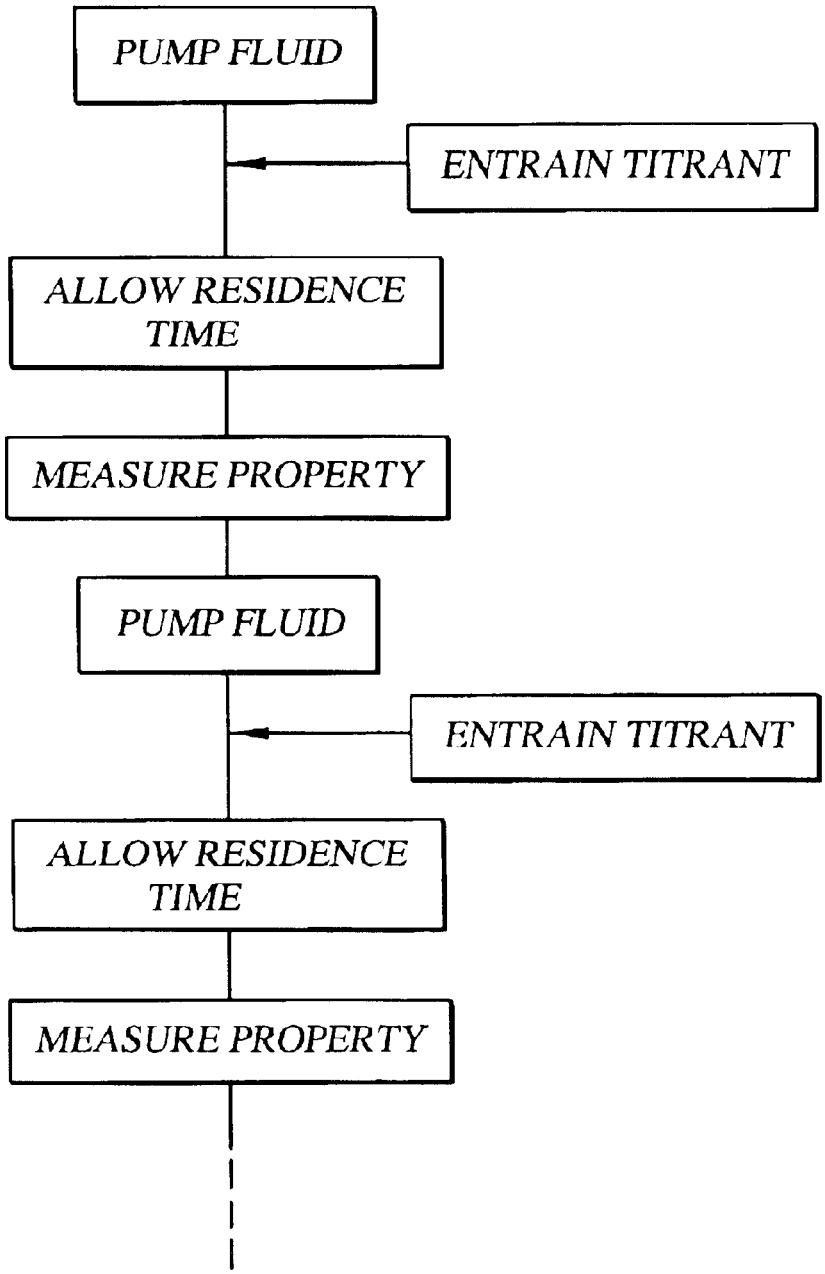
FIG. 7B is a flow chart illustrating a method of titrating a fluid using the techniques of the invention.

An exemplary arrangement of channels and chambers is depicted in FIG. 7A. Pump paths 70 and 72 both entrain fluid from reservoir 74. The operation mechanism of the pump prevents backwash into the reservoir 74 that would contaminate the other channel. Pump path 70 entrains a second fluid from reservoir 76, and pump path 72 entrains a second fluid from reservoir 78. The components of these fluids may react with each other and then be pumped to an outlet or an additional chamber where the reaction products can be analyzed. An accumulation chamber 80 may be provided as a reaction vessel for the fluid in the reservoir and the fluid in the pump. A resistive heater 82 and a thermocouple 84 may be provided in the accumulation chamber to control the temperature of the mixed fluids as they react. FIG. 7B shows a flow chart for a miniaturized titration system. A calibrated amount of fluid is drawn from each reservoir into the fluid stream, and a property of the fluid (pH, conductance, spectrophotometric properties, etc.) is measured after the fluids have a chance to mix.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A microelectromechanical (MEM) device or controlled movement of a fluid, comprising:

a first chamber comprising a heating clement and an inlet;

a channel providing egress from the first chamber, said channel comprising a constriction between the first chamber and at least a second chamber;

a first plurality of chambers and channels serially linked in fluidic communication to each other and to the first chamber; and at least a second plurality of chambers and channels serially linked in fluidic communication to each other and to the first chamber, wherein the first and second plurality of chambers, comprise a common inlet chamber.

2. The MEM device of claim 1, further comprising fluid reservoir and an outlet providing fluidic communication between the fluid reservoir and one of the constrictions.

3. The MEM device of claim 2, further comprising a plurality of outlets providing fluidic communication between the fluid reservoir and a plurality of the constrictions.

4. The MEM device of claim 1, further comprising:

a controller;

and an electrical circuit that is adapted and constructed to provided electrical communication between each heating element and the controller;

wherein the controller causes the heating elements to be activated at predetermined intervals.

5. The MEM device of claim 4, wherein the controller causes a first portion of the heating elements to be activated simultaneously.

6. The MEM device of claim 5, wherein, at a predetermined interval after the first portion of heating elements are activated, the controller causes a second portion of the heating elements to be activated, wherein each of the second portion of heating elements is disposed in a chamber immediately adjacent to a channel providing egress from a chamber comprising one of the first plurality of heating elements.

7. The MEM device of claim 1, further comprising accumulation chamber serially linked in fluidic communication with the plurality of chambers.

8. The MEM device of claim 7, wherein the accumulation chamber does not contain a heating element.

9. The MEM device of claim 1, further comprising a receiving chamber and an outlet providing fluidic communication between the chamber and the receiving chamber.

10. The MEM device of claim 1, further comprising a sensor for detecting a property of the fluid.

11. A lab on a chip using the MEM device of claim 1 to transport a fluid.

12. A microelectromechanical (MEM) device for controlled movement of a fluid, comprising:

a first chamber comprising a heating element and an inlet;

a channel providing egress from the first chamber, said channel comprising a constriction between the first chamber and at least a second chamber;

a first plurality of chambers and channels serially linked in fluidic communication to each other and to the first chamber;

a fluid reservoir and an outlet providing fluidic communication between the fluid reservoir and one of the constrictions; and a plurality of fluid reservoirs, each of which comprises at least one outlet providing fluidic communication with at least one constriction.

13. A microelectromechanical (MEM) device for controlled movement of a fluid, comprising:

a chamber comprising a heating element and an inlet;

a channel providing egress from the chamber, wherein the channel comprises a constriction; and an accumulation chamber serially linked in fluidic communication with the chamber;

wherein the accumulation chamber has a thermocouple.

14. A microelectromechanical (MEM) device for controlled movement of a fluid, comprising:

a chamber comprising a heating element and an inlet;

a channel providing egress from the chamber, wherein the channel comprises a constriction;

a gate valve, the gate valve comprising;

an entrance chamber;

first and second downstream chambers; and first and second gate chambers in fluidic communication with the entrance chamber, each comprising:

a heating element;

a first constriction providing fluidic communication with the entrance chamber; and a second constriction providing fluidic communication between the first and second gate chambers and the first and second downstream chambers, respectively; wherein:

when the first heating element is activated for a time sufficient to vaporize a fluid in the first gate chamber and no voltage is applied to the second heating element, fluid blocked from entering the first downstream chamber from the entrance chamber but can travel between the entrance chamber and the second downstream chamber, and when the second heating element is activated for a time sufficient to vaporize a fluid in the second gate chamber and no voltage is applied to the first sheet resistor, fluid is blocked from entering the second downstream chamber from the entrance chamber but can travel between the entrance chamber and the first downstream chamber.

15. The MEM device of claim 14, wherein the entrance chamber is greater than 1.5 times as large as the gate chamber.

16. The MEM device of claim 14, further comprising at least a third gate chamber in fluidic communication with the entrance chamber via a first constriction, a third downstream chamber in fluidic communication with the third gate chamber via a second constriction, and a third heating element disposed within the third gate chamber.

17. A microelectromechanical (MEM) device for controlled movement of a fluid, comprising:

a first chamber comprising a heating element and an inlet;

a channel providing egress from the chamber, said channel comprising a constriction between the first chamber and at least a second chamber;

a sensor for detecting a property of the fluid; and wherein the property is selected from temperature, pH, composition, absorption of at least one predetermined wavelength, and emission of at least one predetermined wavelength.

18. A microelectromechanical (MEM) device or controlled movement of a fluid, comprising:

a first chamber comprising a heating element and an inlet;

a channel providing egress from the chamber, said channel comprising a constriction between the first chamber and at least a second chamber;

wherein the heating element is a sheet resistor.

19. The MEM device of claim 18, further comprising a passivation layer disposed over the sheet resistor.

20. A MEM device for pumping a fluid, comprising at least a first group of first, second, and terminal chambers serially linked in fluidic communication and each chamber comprising an inlet, a heating element, and a channel providing egress wherein the heating element is a sheet resistor and, wherein;

the channel of each chamber comprises a constriction ending in an inlet for the adjacent chamber, and the heating elements are electrically configured to heat a fluid in the first, second, and terminal chambers sequentially.

21. A MEM device for pumping a fluid, comprising;

at least a first group of first, second, and terminal chambers serially linked in fluidic communication and each chamber comprising an inlet, a heating element, and a channel providing egress, wherein;

the channel of each chamber comprises a constriction ending in an inlet for the adjacent chamber, and the heating elements are electrically configured to heat a fluid in the first, second, and terminal chambers sequentially;

a second group of first, second, and terminal chambers serially linked in fluidic communication and each comprising an inlet, a heating element, and a channel providing egress, wherein:

the channel of each chamber comprises a constriction ending in an inlet in the adjacent chamber, the terminal chamber of the first group is adjacent to the chamber of the second group, the heating elements of the first chamber of each of the first and second groups are configured to heat a fluid in the chambers in each of the first and second groups simultaneously, the heating elements of the second chamber of each of the first and second groups are configured to heat a fluid in the second chambers in each of the first and second groups simultaneously, and the heating elements of the terminal chamber of each of the first and second groups are configured to heat a fluid in the terminal chamber of each of the first and second groups are configured to heat a fluid in the terminal chambers in each of the first and second groups simultaneously.

22. The MEM device of claim 21, wherein each group further comprises at least a third chamber comprising an inlet, a heating element, and a constricted channel providing egress, wherein the third chamber is disposed between the second chamber and the terminal chamber.

23. A method of controlling movement of a fluid, comprising:

providing a first plurality of chambers, wherein each chamber comprises a heating element;

providing a first plurality of channels that provide fluidic communication among the chambers, wherein each channel provides egress from one chamber and an inlet to an adjacent chamber, and comprises a constriction between chambers; and causing at least one of the heating element to vaporize a portion of a fluid in its corresponding chamber for a predetermined amount of time, wherein pressure from the vaporized fluid causes fluid to pass from the chamber into the channel that provides egress from the chamber.

24. The method of claim 23, further comprising allowing the vaporized fluid to condense.

25. The method of claim 24, further comprising temporarily stopping the flow of fluid through a portion of the chambers by maintaining a bubble of vaporized fluid in one of the chambers for a selected period of time.

26. The method of claim 23, further comprising:

providing first and second groups of first, second, and terminal chambers each comprising a heating element;

providing serial fluidic communication among the channels by disposing constricted channels between the chambers, wherein the terminal chamber of the first group is connected to the first chamber of the second group by a constricted channel;

causing the first heating elements of the first and second groups to vaporize at least a portion of a fluid in the first chambers of the first and second groups simultaneously;

causing the second heating elements of the first and second groups to vaporize at least a portion of a fluid in the second chambers of the first and second groups simultaneously; and causing the terminal heating elements of the first and second groups to vaporize at least a portion of a fluid in the terminal chambers of the first and second groups simultaneously.

27. The method of claim 26, further comprising repeating the three steps of causing of claim 26.

28. The method of claim 26, further comprising providing at least a third chamber comprising a heating element to each group, wherein the third chamber is disposed between the second chamber and the terminal chamber.

29. The method of claim 23, further comprising causing a fluid to flow from a fluid reservoir into at least one of the constricted channels by providing fluidic communication between the reservoir and said constricted channel and performing the causing step of claim 23.

30. The method of claim 29, further comprising causing the fluid to flow from the reservoir to a plurality of constricted channels.

31. The method of claim 23, further comprising collecting a portion of the fluid in one of the chambers by providing an outlet in fluidic communication with said chamber and a collection chamber and performing the causing step of claim 23.

32. The method of claim 23, further comprising determining a property of the fluid.

33. The method of claim 32, wherein the property is selected from temperature, pH, composition, emission of at least one preselected wavelength, and absorption of at least one preselected wavelength.

34. The method of claim 23, wherein the heating element is a sheet resistor.

35. The method of claim 34, further comprising disposing a passivation layer over the sheet resistor.

36. The method of claim 23, further comprising providing at least one reservoir in fluidic communication with a preselected channel of the first plurality of channels, wherein, when the step of causing is performed in a chamber adjacent to the preselected channel, a portion of a fluid within the reservoir is drawn into the channel, and wherein the method further comprises measuring a property of the fluid within a chamber downstream of the preselected channel.

37. The method of claim 36, further comprising providing a plurality of reservoirs, each of which is in fluidic communication with a preselected channel of the first plurality of channels, and measuring a property of the fluid within a chamber disposed downstream of each preselected channel.

38. The method of claim 36, further comprising:

providing a second plurality of chambers coupled to a second plurality of channels;

placing the at least one reservoir in fluidic communication with a preselected channel of the second plurality of channels; and measuring a property of the fluid within a chamber of the second plurality of chambers downstream of the second channel.

39. The method of claim 23, further comprising:

providing a second plurality of chambers and constricted channels and providing a common inlet chamber for the first plurality of chambers and the second plurality of chambers.

40. A method of separating a fluid into portions, comprising:

providing an entrance chamber;

disposing first and second gate chambers in fluidic communication with the entrance chamber, wherein the first and second gate chambers are bounded by first and second constrictions and comprise first and second heating elements, disposing first and second egress channels in fluidic communication with the first and second gate chambers, respectively;

applying a voltage to the first heating element for a time sufficient to vaporize fluid in the first gate chamber while allowing fluid to flow from the entrance chamber to the second egress channel;

removing the voltage on the first heating element; and applying a voltage to the second heating element for a time sufficient to vaporize fluid in the second gate chamber while allowing fluid to flow from the entrance chamber to the first egress channel.

41. The method of claim 40, further comprising placing at least a third gate chamber in fluidic communication with the entrance chamber and a third egress channel in fluidic communication with the third gate chamber.

42. A microelectromechanical (MEM) device for controlled movement of a fluid, comprising:

a plurality of chambers in series fluidic communication, each chamber having a channel providing egress, and including a constriction between chambers; and means for directing flow of a fluid within each chamber substantially from a chamber inlet to a chamber outlet, wherein at least a portion of the chambers comprise a heating element, wherein the heating element is a sheet resistor.

43. A microelectromechanical (MEM) device for controlled movement of a fluid, comprising:

a plurality of chambers in series fluidic communication, each chamber having a channel providing egress and including a constriction between chambers; and means for directing flow of a fluid within each chamber substantially from a chamber inlet to a chamber outlet, wherein at least a portion of the chambers comprise a heating element, and wherein the chamber outlet has a larger diameter than that of the chamber inlet.

44. A microelectromechanical (MEM) device for controlled movement of a fluid comprising:

a plurality of chambers in series fluidic communication, each chamber having a channel providing egress and including a constriction between chambers; and means for directing flow of a fluid within each chamber substantially from a chamber inlet to a chamber outlet;

wherein at least a portion of the chambers comprise a heating element; and a second plurality of chambers and means for permitting fluid travel within a member of the first plurality, the second plurality, and both simultaneously.

45. A microelectromechanical (MEM) device or controlled movement of a fluid, comprising:

a plurality of chambers in series fluidic communication and each comprising an inlet and an outlet, said outlet comprising a channel having a constriction between the chambers; and means for introducing an additional fluid to the fluid as it flows between chambers, wherein at least a portion of the chambers comprise a heating element.

46. The MEM device of claim 45, further comprising means for mixing the additional fluid and the fluid.

* * * * *

UNITED STATES PATENT AND TRADEMARK OFFICE

CERTIFICATE OF CORRECTION

PATENT NO. : 6,869,273 B2
APPLICATION NO. : 10/147153
DATED : March 22, 2005
INVENTOR(S) : Crivelli It is certified that error appears in the above-identified patent and that said Letters Patent is hereby corrected as shown below:

Col. 7 (line 23), after “comprising”, insert --a--.

Col. 7 (line 48), before “accumulation”, insert --an--.

Col. 8 (line 36), after “fluid”, insert --is--.

Col. 9 (line 11), delete “comprising” and insert therefor --comprising:--.

Col. 12 (line 36), delete “or” and insert therefor --for--.

Signed and Sealed this

Fifth Day of December, 2006

JON W. DUDAS
*Director of the United States Patent and Trademark Office*